US006098573A

United States Patent [19]

Oyagi et al.

[11] Patent Number: 6,098,573

[45] **Date of Patent: *Aug. 8, 2000**

[54] METHOD AND APPARATUS FOR CLEANING BOILER OF POWER GENERATION PLANT

[75] Inventors: Kiyoto Oyagi; Tadashige Inoue, both of Yokohama; Masaru Amemiya, Hiratsuka; Tetsunori Hisatsune, Fujisawa, all of Japan

[73] Assignee: Kabushiki Kaisha Toshiba, Kawasaki, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/987,607

[22] Filed: Dec. 9, 1997

[30] Foreign Application Priority Data

Dec. 10, 1996 [JP] Japan ..... 8-329920

[51] Int. Cl.[7] ..... F22B 37/48

[52] U.S. Cl. ..... 122/401; 134/40

[58] Field of Search ..... 122/401; 134/22.1, 134/22.11, 22.12, 22.14, 22.19, 40, 99.2, 100.1, 166 R

[56] References Cited

U.S. PATENT DOCUMENTS

| | | | |
|---|---|---|---|
| 846,051 | 3/1907 | Ray | 122/401 |
| 3,581,714 | 6/1971 | Smith | 122/401 |
| 4,230,577 | 10/1980 | Bennecke et al. | 122/401 |
| 4,664,067 | 5/1987 | Haneda et al. | 122/7 R |
| 4,913,823 | 4/1990 | Lipinski et al. | 134/22.19 |
| 4,915,119 | 4/1990 | Franklin | 134/100 |
| 5,152,252 | 10/1992 | Bolton et al. | 122/401 |
| 5,193,491 | 3/1993 | Oslin et al. | 122/401 |
| 5,527,468 | 6/1996 | Boyette et al. | 134/22.19 |
| 5,529,702 | 6/1996 | Segrave et al. | 134/10 |
| 5,538,024 | 7/1996 | Inada et al. | 134/60 |

OTHER PUBLICATIONS

H. Tsuboya, et al., Thermal and Nuclear Power Engineering Association, Japanese Magazine, vol. 43, No. 10, pp. 128–159, "The Thermal and Nuclear Power", Oct. 1992.

Thermal and Nuclear Power Engineering Association, Japanese Magazine , vol. 43, No. 10, pp. 1293 & 1294, Oct. 1992, "The Thermal and Nuclear Power".

*Primary Examiner*—John A. Jeffery
*Assistant Examiner*—Gregory A. Wilson
*Attorney, Agent, or Firm*—Oblon, Spivak, McClelland, Maier & Neustadt, P.C.

[57] ABSTRACT

A method of cleaning a boiler of a power generation plant is performed removing an oil component remaining in an interior of the boiler before a steady operation of the power generation plant. For such cleaning, a surface active agent is used as a cleaning liquid, and a cleaning liquid tank, into which the cleaning liquid is stored, is temporarily located, which is connected to a boiler feed water pipe through a cleaning liquid injection pipe and a cleaning liquid injection pump, by which the cleaning liquid is injected into the boiler feed water pipe in a controlled manner to feed the cleaning liquid into the boiler.

7 Claims, 3 Drawing Sheets

METHOD AND APPARATUS FOR CLEANING BOILER OF POWER GENERATION PLANT

BACKGROUND OF THE INVENTION

The present invention relates to method and apparatus for cleaning a boiler of a power generation plant, and in particular, to a boiler cleaning method and apparatus for removing oil components remaining in a boiler before a steady operation of the power generation plant.

In a boiler of a thermal power generation plant, or in an exhaust gas heat recovery boiler of a combined cycle power generation plant composed of gas turbine facilities and steam turbine facilities, there remains various kinds of oils such as grease and the like which have applied and adhered when manufacturing, assembling or repairing the boilers. If the boiler is operated in a state in which such oil components remain therein, these oils foam or adhere to the interior of a boiler tube, causing the problems such as carbonization, hardness scale, local superheat or the like. For this reason, after construction of the power generation plant, it is general that the interior of the boiler is subjected to a cleaning treatment before the operation thereof in order to remove remaining oils.

Referring now to FIG. 3, a conventional boiler cleaning method will be described below. FIG. 3 is a system diagram showing an arrangement in the vicinity of one of boiler drums of an exhaust gas heat recovery boiler in a combined cycle power generation plant.

A feed water pump 2 is connected to a boiler feed water pipe 1. During an operation of the boiler, water pressurized by the feed water pump 2 is supplied to a economizer 3, and thereafter, is fed to a boiler drum 5 via a feed water flow control valve 4. The water stored in the boiler drum 5 is heated and vaporized by a gas turbine exhaust gas flowing through an exhaust gas passage 7 in a vaporizer 6. The generated steam is superheated by a superheater 8, and then, is fed to a steam turbine. The boiler drum 5 is provided with a manhole 9.

In order to remove a residual oil remaining in the boiler drum 5 after the construction of the plant and before an operation thereof, in the known art, there is provided an alkali cleaning method in which a lid of the manhole 9 is opened, and alkali chemicals, e.g., various soda chemicals are injected through the manhole 9 into the boiler drum 5 as a cleaning liquid or deoiling cleaning method including a combined heating process, which is called as soda boiling method.

However, according to the conventional cleaning methods mentioned above, it takes much time and labor to open and close the manhole 9 of the boiler drum 5 generally having a large-scale and to perform attachment and detachment of a heat insulating material, and moreover, large-scale facilities are required for injecting chemicals. Further, many kinds of chemicals such as cleaning chemicals, neutralization chemicals and the like are used. For this reason, there have arisen problems of cost increasing and long cleaning time being required.

In recent years, the combined cycle power generation plant or the like requires large-scale facilities, and for this reason, in particular, there have arisen earnest demands that the cost required for construction or repairing is reduced, and a commercial operation can be started in the course of a short time. Accompanying with such demands, it is desired to reduce the cost relevant to boiler cleaning and to shorten a work time.

SUMMARY OF THE INVENTION

An object of the present invention is to substantially eliminate defects or drawbacks encountered in the prior art described above and to provide method and apparatus for cleaning a boiler of a power generation plant capable of easily and promptly performing a boiler cleaning working by using a simple cleaning system by using a cheap cleaning liquid, which is easily treated in a waste water treatment after the cleaning.

This and other objects can be achieved according to the present invention by providing, in a general aspect, a method of cleaning a boiler of a power generation plant for cleaning the boiler by removing an oil component remaining in an interior of the boiler before a steady operation of the power generation plant, wherein a surface active agent is used as a cleaning liquid and the surface active agent is injected into a boiler feed water pipe connected to the boiler for feeding water thereto.

In a preferred aspect, there is provided a method of cleaning a boiler of a power generation plant for cleaning the boiler by removing an oil component remaining in an interior of the boiler before a steady operation of the power generation plant, the method comprising the steps of:

preparing a surface active agent as a cleaning liquid;

temporarily locating a cleaning liquid tank, into which the cleaning liquid is stored, and a cleaning liquid injection pipe connecting the cleaning liquid tank and a boiler feed water pipe for feeding water to the boiler through a cleaning liquid injection pump; and supplying the cleaning liquid into the boiler feed water pipe from the cleaning liquid tank in a controlled manner to supply the cleaning liquid into the boiler.

In another preferred aspect, there is provided an apparatus for cleaning a boiler of a power generation plant for cleaning the boiler by removing an oil component remaining in an interior of the boiler before a steady operation of the power generation plant, the boiler being supplied with water through a boiler feed water pipe, the apparatus comprising:

a cleaning liquid tank into which a surface active gent as a cleaning liquid is stored;

a cleaning liquid injection pump operatively connected to the cleaning liquid tank;

a cleaning liquid injection pipe operatively connected to the cleaning liquid tank through the cleaning liquid injection pipe and to the boiler feed water pipe; and means for controlling a timing of supplying the cleaning liquid, the cleaning liquid tank, the cleaning liquid injection pump, the cleaning liquid injection pipe and the controlling means being temporarily arranged to the boiler of a power generation plant before the steady operation.

In preferred embodiments of these aspects, the cleaning liquid essentially consists of a nonionic surface active agent having a concentration of 50 to 100 ppm. The surface active agent is polyoxyethylene-alkyl-phenylether.

The cleaning liquid is injected at a timing of a no-load operation of the power generation plant. The cleaning method may further comprises cleaning the boiler with a boiler water after the no-load operation period and before 100% load operation.

The cleaning liquid may be continuously injected.

The boiler is preferably an exhaust gas heat recovery boiler of a combined cycle power generation plant which combines gas turbine facilities and steam turbine facilities.

According to the boiler cleaning method and apparatus of the present invention mentioned above, the surface active agent is used as a cleaning liquid, whereby the same cleaning effect can be more cheaply obtained as compared with the conventional cleaning method by which the oil components are removed from the boiler with use of a many kinds of cleaning chemicals or neutralization chemicals. Further, since the cleaning liquid is supplied by taking advantage of the boiler feed water pipe, it is possible to dispense with opening and closing works of the manhole of the boiler drum, time and labor spent for attachment or detachment of heat insulating materials accompanying with the works and large-scale facilities. Therefore, simplification of working facilities can be performed, and time and labor spent for works can be greatly reduced. In particular, in the case where the method of the present invention is applied to a combined cycle power generation plant which requires large-scale facilities, it is very effective in a reduction of the cost spent for the construction or the like and in the start of the commercial operation at a short time. It is also preferable that a regulated volume supply pump is used as the cleaning liquid injection pump.

Furthermore, the nonionic surface active agent effectively acts for the removal of both of vegetable oils and animal oils. Further, it is preferable that the concentration of the surface active agent is set at a range from 50 to 100 ppm. If the concentration of the surface active agent is less than 50 ppm, it is insufficient as a concentration for the removal of oils, and on the other hand, if the concentration of the surface active agent exceeds 100 ppm, the COD (Chemical Oxygen Demand) concentration becomes excessively high in the light of a wastewater regulating value. For this reason, the wastewater treatment work is troublesome. Thus, the concentration of the surface active agent is set within the above range from 50 to 100 ppm, and according to this manner, there is obtained a saturation concentration capable of sufficiently removing the oil components, and foaming is limited, so that carry-over from the boiler to the downstream side can be restricted. Moreover, since the COD concentration does not excessively high in the light of a wastewater regulating value, this serves to reduce the wastewater treatment work.

In the present invention, furthermore, the cleaning work combines with a hot water clean-up while being efficiently performed at the same time with a start up operation. Further, in the case of the combined cycle power generation plant, it is preferable that the injection timing is set at the time of no-load operation of a gas turbine and the oils are hence removed before a great thermal load is applied. Therefore, the influence on the plant system can be restricted. In this case, more preferably, the injection (cleaning) timing is set at the time after a no-load operation after the initial ignition of a gas turbine, that is, at the time before the second no-load operation after confirmed that the gas turbine has been preferably operated. If the timing is set as described above, even if the initial ignition of the gas turbine misses, the concentration of the cleaning agent is not lowered due to the blow-down of boiler water; therefore, a re-injection work is also unnecessary.

The nature and further characteristic features of the present invention will be made more clear from the following descriptions made with reference to the accompanying drawings.

DESCRIPTION OF THE PREFERRED EMBODIMENT

Figure 1:
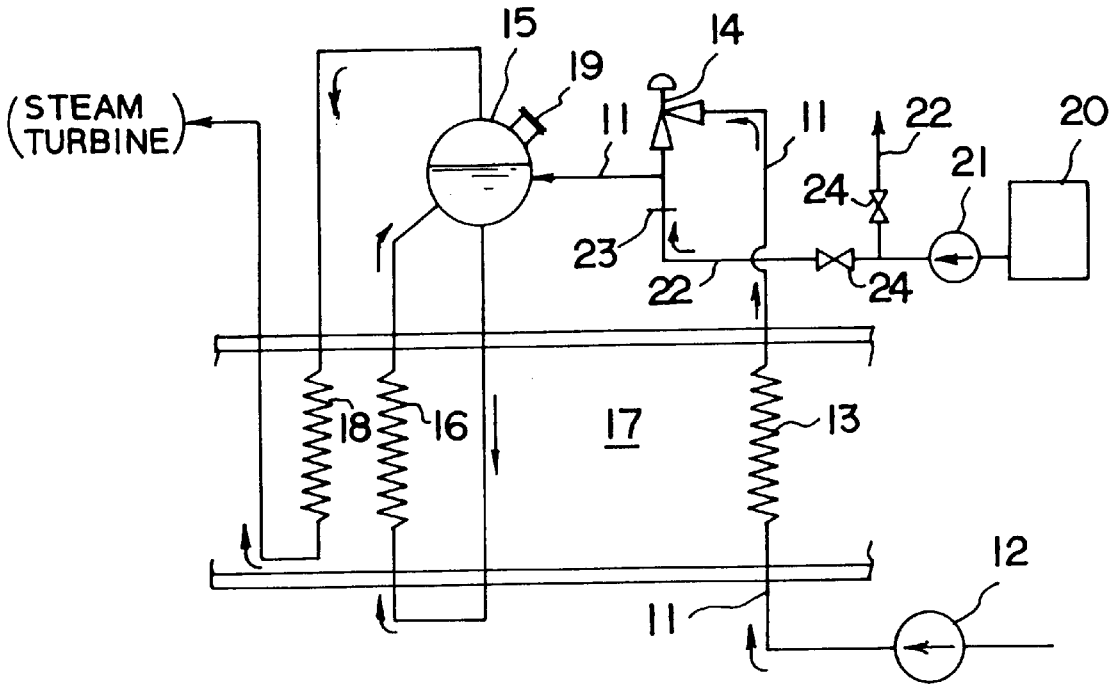
FIG. 1 is a system diagram to explain a boiler cleaning method of a power generation plant by using a boiler cleaning apparatus according to an embodiment of the present invention.

One embodiment of the present invention will be described hereunder with reference to FIG. 1 and FIG. 2.

In the embodiment, the present invention has been applied to cleaning of an exhaust gas heat recovery boiler of a combined cycle power generation plant. In FIG. 1, there is shown a system installed in the vicinity of one boiler drum among a plurality of boiler drums. In the system, a feed water pump 12 is provided in a boiler feed water pipe 11, and water pressurized by the feed water pump 12 is supplied to an economizer 13 as shown by an arrow in FIG. 1, and thereafter, is fed to a boiler drum 15 via a feed water flow control valve 14. Then, the water stored in the boiler drum 15 is heated and vaporized in a vaporizer 16 by a gas turbine exhaust gas flowing through an exhaust gas passage 17, and further, is superheated by a superheater 18 and fed to a steam turbine. The boiler drum 15 is provided with a manhole 19.

In addition to the facilities as described above, according to the present embodiment, the vicinity of the boiler drum 15 is temporarily provided with a cleaning liquid tank 20 for storing a cleaning liquid, and a cleaning liquid injection pipe 22 including a cleaning liquid injection pump 21, which is a regulated volume supply pump for supplying the cleaning liquid from the cleaning liquid tank 20. The cleaning liquid injection pipe 22 is removably connected to the boiler feed water pipe 11 via a pipe joint 23. Further, the cleaning liquid injection pipe 22 diverges from the midway thereof, and another cleaning liquid injection pipe 22 thus diverged is connected to another boiler drum (not shown). A valve 24 is provided on a downstream side of the diverged point of the respective cleaning liquid injection pipes 22.

The cleaning liquid tank 20 is stored with a surface-active agent (surfactant) as a cleaning liquid. In the present embodiment, chemicals, preferably such as polyoxyethylene-alkyl-phenylether, which is a nonionic surface active agent, are used as the cleaning liquid, and a cleaning test was conducted under the condition that various modifications have been made within a concentration range from 30 to 500 ppm.

In the case where cleaning is carried out with respect to the boiler drum 15, a valve 24 of the cleaning liquid injection pipe 22 connected to the boiler drum 15 to be cleaned is opened, and then, the cleaning liquid injection pump 21 is started up. Through this operation, a predetermined amount of surface active agent, which is used as the cleaning liquid stored in the cleaning liquid tank 20, is pressurized by the cleaning liquid injection pump 21, and then, is injected into the boiler drum 15 through the cleaning liquid injection pipe 22. The cleaning can be simultaneously carried out with respect to a plurality of boiler drums 15 through the diverged respective cleaning liquid injection pipes 22. In the present embodiment, an injection timing of the surface active agent into the boiler was set at the time after a no-load operation after the initial ignition of a gas turbine, that is, at the time before the second no-load operation after the confirmation of the fact that the gas turbine has been preferably operated. Further, water washing for blowing down boiler water was carried out several times until the gas turbine has reached a 100-percent load state after the no-load operation.

As described above, according to the present embodiment, only the surface active agent has been used as a cleaning liquid, whereby the same cleaning effect can be more cheaply obtained as compared with the conventional cleaning method in which the oil from the boiler has been removed with the use of many kinds of cleaning chemicals or neutralization chemicals. Further, since the cleaning liquid is supplied by taking advantage of the boiler feed water pipe 11, it is possible to dispense with opening and closing works of the manhole 19 of the boiler drum 15, time and labor spent for attachment or detachment of heat insulating materials accompanying with the works, and large-scale facilities. Therefore, the working facilities can be simplified, and time and labor spent for works can be greatly reduced.

Moreover, in the present embodiment, chemicals, preferably, polyoxyethylene-alkyl-phenylether, which is a nonionic surface active agent, are used as the cleaning liquid, so that the oils remaining in and adhering to the exterior of the boiler drum 15 can be securely removed therefrom. In this case, it can be seen from the following description that a preferable concentration of nonionic surface active agent ranges from 50 to 100 ppm.

Figure 2:
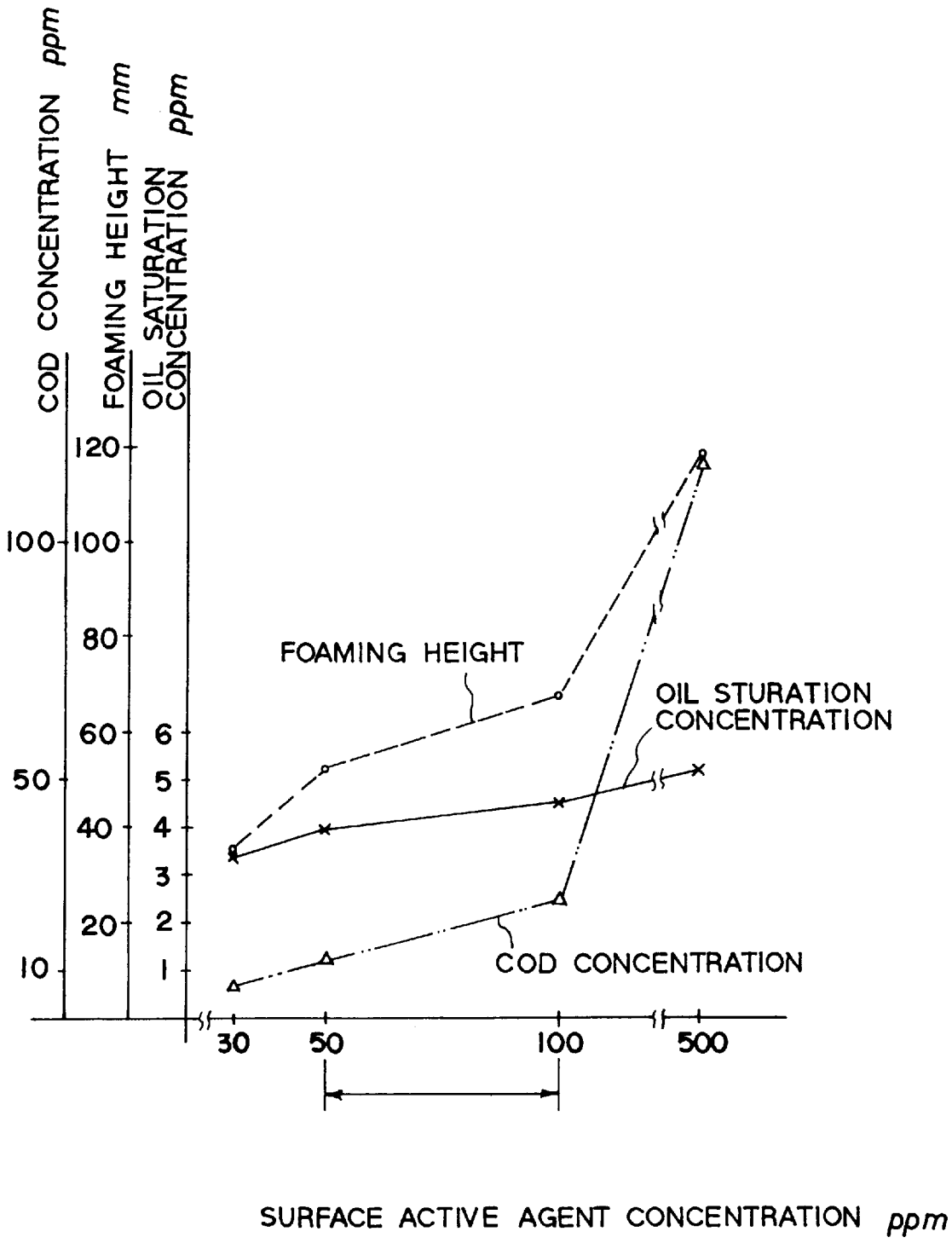
FIG. 2 is a chart showing characteristics of a surface-active agent which is used in the above embodiment.
Figure 3:
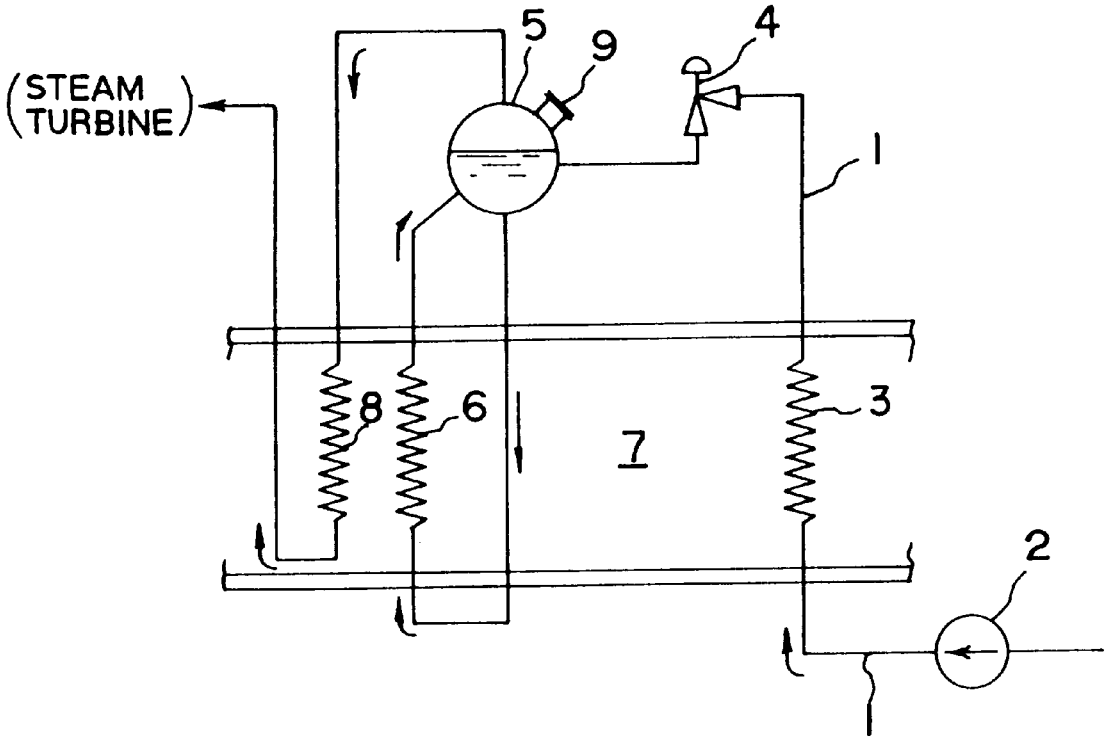
FIG. 3 PRIOR ART
FIG. 3 is a system diagram for explaining a conventional boiler cleaning method.

Specifically, FIG. 2 shows characteristics of the surface active agent. In FIG. 2, a concentration (ppm) of a surface active agent is taken as an abscissa, and an oil saturation concentration (ppm), a foam height (mm) and a COD (Chemical Oxygen Demand) concentration (ppm) are taken as an ordinate to express the relationship therebetween.

As seen from FIG. 2, in the case where the concentration of the surface active agent ranges from 50 to 100 ppm, the oil saturation concentration for the removal of oils is 40 to 45 ppm and is sufficiently satisfied. Further, a foaming height is less than about 65 mm and is extremely low, so that the carry-over from the boiler drum 15 can be restricted. Furthermore, the COD concentration is about 20 ppm and does not become excessively high in the light of a general wastewater regulating value, and therefore, this serves to reduce a wastewater treatment work.

Namely, in the present embodiment, a cleaning agent which is effective in the removal of oils remaining in the boiler drum 15 is injected thereto at the optimum timing, whereby the cleaning of the boiler drum 15 can be effectively performed at a low cost for a short time without using many kinds of cleaning chemicals or neutralization chemicals.

In the above embodiment, the present invention has been applied to the case of cleaning the exhaust gas heat recovery boiler of the combined cycle power generation plant. The present invention is properly applicable to boiler cleaning of a general thermal power generation plant.

As is evident from the above detailed description, in the boiler cleaning method of a power generation plant according to the present invention, the surface active agent which is used as a cleaning agent effective in the removal of oils is injected at the optimum timing, whereby the simplification of working facilities can be achieved, a work can be readily and promptly performed, oils can be securely removed with an inexpensive cleaning liquid, and further, after-treatment or the like can be readily performed.

What is claimed is:

1. A method of cleaning a boiler of a power generation plant for cleaning the boiler by removing an oil component adhering and remaining to an interior surface of the boiler at the time of after manufacturing the same and before starting a steady operation of the power generation plant, said method comprising the steps of:

preparing a surface active agent as a cleaning liquid having a predetermined concentration;

temporarily locating a cleaning liquid tank, into which the cleaning liquid is stored, and a cleaning liquid injection pipe connecting the cleaning liquid tank and a boiler feed water pipe for feeding water to the boiler through a cleaning liquid injection pump;

supplying the cleaning liquid into the boiler feed water pipe from the cleaning liquid tank in a controlled manner to supply the cleaning liquid into the boiler at a timing of a no-load operation of the power generation plant; and cleaning the boiler with a boiler water after the no-load operation period and before 100% load operation.

2. A method of cleaning a boiler of a power generation plant according to claim 1, wherein said cleaning liquid essentially consists of a nonionic surface active agent having a concentration of 50 to 100 ppm.

3. A method of cleaning a boiler of a power generation plant according to claim 2, wherein said surface active agent is polyoxyethylene-alkyl-phenylether.

4. A method of cleaning a boiler of a power generation plant according to claim 1, wherein said cleaning liquid is continuously injected.

5. A method of cleaning a boiler of a power generation plant according to claim 1, wherein the boiler is an exhaust gas heat recovery boiler of a combined cycle power generation plant which is composed of a combination of gas turbine facilities and steam turbine facilities.

6. An apparatus for cleaning a boiler of a power generation plant for cleaning the boiler by removing an oil component remaining in an interior of the boiler before a steady operation of the power generation plant, said boiler being supplied with water through a boiler feed pipe, said apparatus comprising:

a cleaning liquid tank into which a surface active agent as a cleaning liquid is stored;

a cleaning liquid injection pump operatively connected to the cleaning liquid tank;

a cleaning liquid injection pipe operatively connected to the cleaning liquid tank through the cleaning liquid injection pipe and to the boiler feed water pipe; and means for controlling a timing of supplying the cleaning liquid during a no-load operation of the power generation plant;

said cleaning liquid tank, said cleaning liquid injection pump, said cleaning liquid injection pipe and said controlling means being temporarily arranged to the boiler of a power generation plant before the steady operation.

7. An apparatus for cleaning a boiler of a power generation plant according to claim 6, wherein said cleaning liquid injection pump is a regulated volume supply pump.

* * * * *